US010122061B2

(12) United States Patent
Letaief et al.

(10) Patent No.: US 10,122,061 B2
(45) Date of Patent: Nov. 6, 2018

(54) COAXIAL RESONATOR WITH DIELECTRIC TIP

(71) Applicant: TELEFONAKTIEBOLAGET LM ERICSSON (PUBL), Stockholm (SE)

(72) Inventors: Anis Letaief, Bro (SE); Hamed Jahja, Upplands Väsby (SE); Piotr Jedrzejewski, Järfälla (SE)

(73) Assignee: Telefonaktiebolaget LM Ericsson (publ), Stockholm (SE)

( * ) Notice: Subject to any disclaimer, the term of this patent is extended or adjusted under 35 U.S.C. 154(b) by 0 days.

(21) Appl. No.: 15/323,871

(22) PCT Filed: Nov. 29, 2016

(86) PCT No.: PCT/SE2016/051182
§ 371 (c)(1),
(2) Date: Jan. 4, 2017

(87) PCT Pub. No.: WO2017/095310
PCT Pub. Date: Jun. 8, 2017

(65) Prior Publication Data

US 2017/0301976 A1 Oct. 19, 2017

Related U.S. Application Data

(60) Provisional application No. 62/262,965, filed on Dec. 4, 2015.

(51) Int. Cl.

| | |
|---|---|
| ***H01P 1/205*** | (2006.01) |
| ***H01P 7/04*** | (2006.01) |
| ***H01P 1/202*** | (2006.01) |

(52) U.S. Cl.
CPC ..... *H01P 7/04* (2013.01); *H01P 1/202* (2013.01); *H01P 1/2053* (2013.01)

(58) Field of Classification Search
CPC ..... H01P 1/202; H01P 1/205; H01P 1/2053; H01P 7/04
USPC ..... 333/203, 206, 207
See application file for complete search history.

(56) References Cited

U.S. PATENT DOCUMENTS

| | | | | |
|---|---|---|---|---|
| 4,151,494 | A * | 4/1979 | Nishikawa | H01P 1/205 333/204 |
| 4,268,809 | A | 5/1981 | Makimoto et al. | |
| 4,389,624 | A | 6/1983 | Aihara et al. | |
| 4,434,410 | A * | 2/1984 | Miyake | H01P 7/04 333/207 |

(Continued)

FOREIGN PATENT DOCUMENTS

| | | | |
|---|---|---|---|
| DE | 2014001917 | A1 | 8/2015 |
| JP | 2008098729 | A | 4/2008 |
| WO | 2004105173 | A1 | 12/2004 |

*Primary Examiner* — Rakesh Patel
(74) *Attorney, Agent, or Firm* — Sage Patent Group

(57) ABSTRACT

A coaxial resonator is provided. The coaxial resonator has a first side and a second side, the coaxial resonator comprising a dielectric disc having a first surface, a second surface and a hole, wherein the second side of the coaxial resonator is connected to the first surface of the dielectric disc, wherein the coaxial resonator further comprises a conductive element connected to second surface of the dielectric disc. A filter comprising a housing, comprising a lid/cover and a chassis having one or more cavities adapted for receiving a coaxial resonator is also provided.

20 Claims, 5 Drawing Sheets

(56) References Cited

U.S. PATENT DOCUMENTS

| | | | | |
|---|---|---|---|---|
| 8,773,222 | B2 | 7/2014 | Myllyvainio et al. | |
| 2006/0038640 | A1 * | 2/2006 | D'Ostilio ..... | H01P 7/04 333/223 |
| 2006/0284708 | A1 | 12/2006 | Reeves | |
| 2015/0280302 | A1 | 10/2015 | Seo et al. | |

* cited by examiner

COAXIAL RESONATOR WITH DIELECTRIC TIP

This application is a 371 of International Application No. PCT/SE2016/051182, filed Nov. 29, 2016, which claims the benefit of U.S. Application No. 62/262,965, filed Dec. 4, 2015, the disclosures of which are fully incorporated herein by reference.

TECHNICAL FIELD

The present disclosure relates to coaxial resonators and in particular to a coaxial resonator with dielectric disc and metallic element on top of dielectric disc.

BACKGROUND

The bandpass filter is in a simplest form composed of a plurality of resonators arranged in such a way that the input signal is put to an input port, then to the first resonator and then passes sequentially second and other resonators until it reaches the last resonator and leaves the filter at an output port.

Radio Frequency, RF, bandpass filters in e.g. a base station use air cavity coaxial resonators. This technology is applied to build filter used in base stations that handle moderate and high power levels between 10-120 W RF power at frequencies about 500-3000 MHz.

Dielectric resonators are used to shrink the filter size and obtain higher Q value in bandpass filters. The Q value is a quality factor of a resonator, e.g. ratio between stored energy and dissipated energy within the resonator. Different dielectric resonators with different operating mode are used. Some solutions use Transverse Electric, TE, mode that has very high Q value and moderate size reduction.

Another example is to use a Transverse Magnetic, TM, mode dielectric resonator. It offers higher Q in the same volume and good power handling capability. The advantage with TM-mode technique is explained in detail in Ericsson U.S. Pat. No. 8,773,222 B2.

Today's market offers a range of high dielectric material with dielectric permittivity from 10 to 48 with sufficient RF properties such as Q value and thermal expansions coefficient with a reasonable manufacturing cost. These types of dielectric materials have been used in filter with TE mode and TM mode for frequency band above 1 GHz.

The previous technologies have size problems at low frequencies below 1 GHz thus hampering smaller base stations.

SUMMARY

The object is to obviate at least some of the problems outlined above. In particular, it is an object to provide a coaxial resonator whereby when used in a filter, it allows for filtering low frequencies below 1 GHz. These objects and others may be obtained by providing a coaxial resonator and a filter according to the independent claims attached below. A further object is to enable smaller filters at lower frequencies e.g. below 1 GHz.

According to an aspect, a coaxial resonator is provided. The coaxial resonator has a first side and a second side, the coaxial resonator comprises a dielectric disc having a first surface, a second surface and a hole, wherein the second side of the coaxial resonator is connected or fastened to the first surface of the dielectric disc wherein the coaxial resonator further comprises a conductive element connected to second surface of the dielectric disc.

According to an aspect, a filter is provided. The filter comprises a housing, comprising a lid/cover and a chassis having one or more cavities adapted for receiving at least one coaxial resonator according to any of the embodiments as described herein.

The coaxial resonator and the filter have several advantages. One possible advantage is that the embodiments may enable smaller filters at lower frequencies. The coaxial resonator may improve power handling which may be important with reduced size of filter. The quality factor may be improved. The air gap between cover lid and top surface of conventional coaxial resonator is replaced by a dielectric disc which may make temperature shift of frequency easier to control by choosing of proper thermal expansion coefficient of dielectric disc. By having the conductive element being part of the coaxial resonator, not only is a better contact between the dielectric material and the conductive element achieved, but also, having the conductive element being relatively thin thereby somewhat flexible, the conductive element-compensates for expansion and/or shrinking of the material of e.g. the housing of the filter due to temperature changes. Further, the coaxial resonator described herein is also easily replaceable since it is fastened to the filter by being inserted into a hole of the lid or cover of the filter, the filter comprising a housing comprising a chassis and the lid/cover. The chassis may have one or more cavities and the cover/lid has one or more holes corresponding to the cavities. The coaxial resonator described herein may be inserted into the hole of the cover/lid, thereby being positioned in one of the cavities of the chassis. Once inserted into the hole, the coaxial resonator may be screwed or otherwise fastened to the bottom or the floor of the chassis and also being fastened to the cover/lid by means of being screwed in the lid/cover. In this manner, the coaxial resonator may be removed from the filter if necessary, for example if it malfunctions and needs to be replaced. A new coaxial resonator may then be inserted into the hole and fastened as described above and then optionally also tuned. In typical filters, to replace one of the resonators, a cover/lid needs to be removed and later on placed again on a chassis of the filter. In such a case all resonators can be affected and costly retuning of a whole filter could be needed. This solution has significantly higher costs when compared to the presented solution where only one resonator needs to be replaced and/or tuned.

BRIEF DESCRIPTION OF DRAWINGS

Embodiments will now be described in more detail in relation to the accompanying drawings, in which.

DETAILED DESCRIPTION

A dielectric permittivity higher than approximately 80 with sufficient RF properties and a reasonable cost needs to be able to use TM mode resonator for low frequency band to keep the same size of filter as it is for high frequency band. Unfortunately, authorized dielectric material suppliers could not succeed to develop dielectric material with higher permittivity than approximately 48 that has sufficient RF properties such as Q value and temperature coefficient.

Embodiments herein relate to e.g. a modified resonator design that works with quasi-TEM by adding a dielectric disc on top of a standard coaxial resonator made of metal. Such embodiments may enable smaller filters at lower frequencies below 1 GHz, e.g. allowing keeping building practice with the same size for different frequencies.

Figure 1:
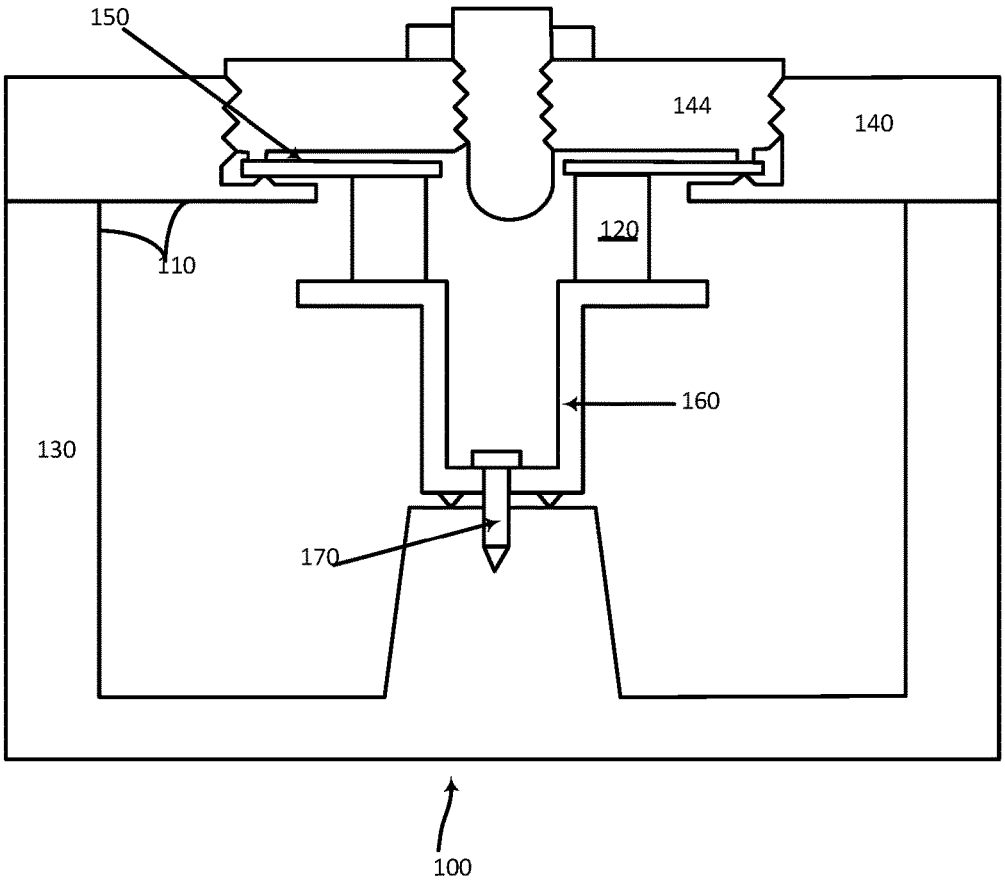
FIG. 1 is a cross section of filter assembly 100 according to an exemplifying embodiment.
Figure 6:
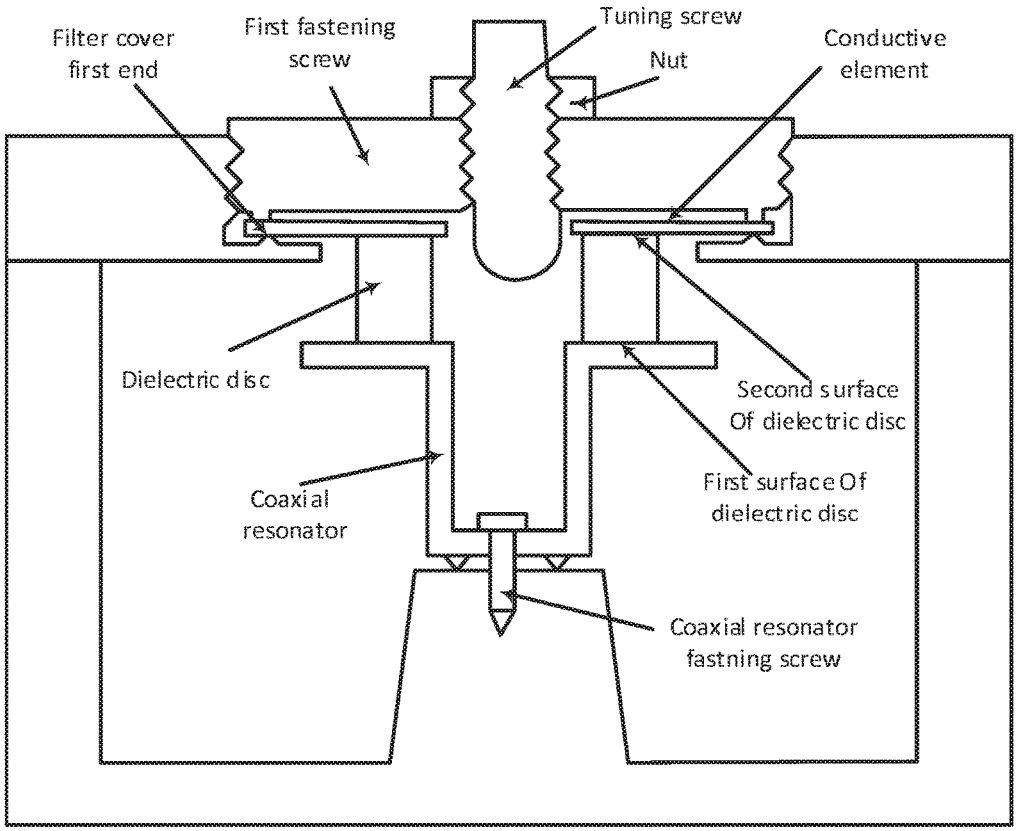
FIG. 6 is a cross section of filter assembly 100 according to an exemplifying embodiment.

FIGS. 1 and 6 are cross sections of filter assembly 100 according to an exemplifying embodiment. A filter housing 110 comprises a coaxial resonator 160 with a dielectric disc 120 with a hole, on top of the coaxial resonator 160. The filter assembly 100 may comprise one or more coaxial resonators 160 with a respective dielectric disc 120.

FIGS. 1 and 6 illustrate the coaxial resonator 160 being made of metal being connected from top side to the first surface of a dielectric disc 120 with a hole. Even though not illustrated in the figures, the coaxial resonator and the dielectric disc 120 seen from above are generally circular, wherein the dielectric disc 120 is also generally circular and has a hole at its centre. The dielectric disc 120 with a hole is connected to a conductive element 150 on the second surface. However, it shall be pointed out that the dielectric disc 120 seen from above may be oval, polygon with e.g. 6, 8 or 12 walls/sides etc. or any other shape having a hole as described in more detail below.

Embodiments herein relate to a coaxial resonator, which will now be described with reference to FIG. 4.

Figure 4:
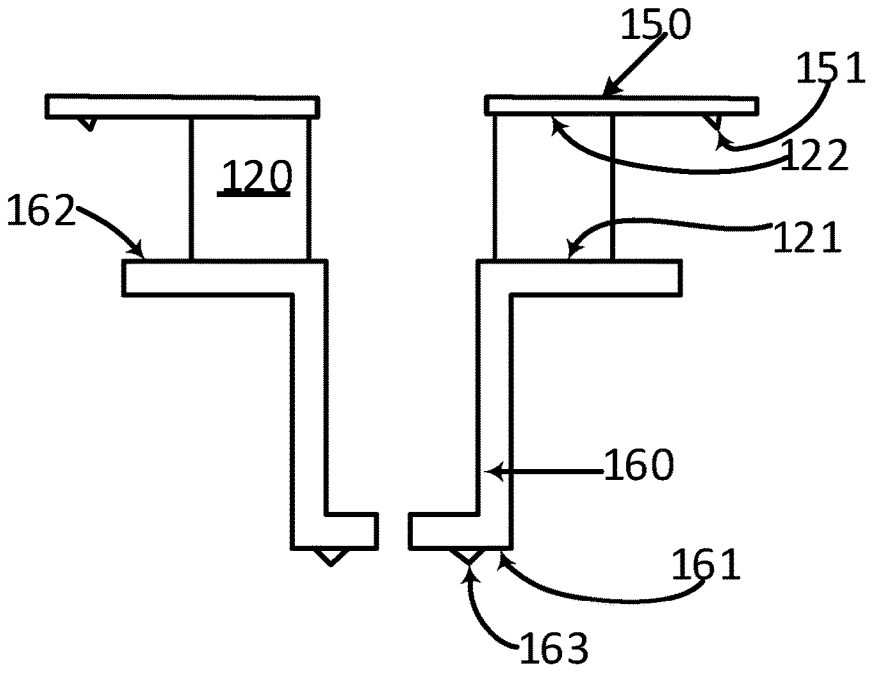
FIG. 4 is an illustration of a cross section of a coaxial resonator 160 with a dielectric disc 120 with a hole placed on the coaxial resonator 160 and a conductive element 150 placed on dielectric disc 120.

FIG. 4 is an illustration of a cross section of a coaxial resonator 160 with a dielectric disc 120 with a hole placed, on the coaxial resonator 160. A conductive element 150 is connected/fastened to dielectric disc 120.

FIG. 4 illustrates the coaxial resonator 160 having a first side 161 and a second side 162, wherein the coaxial resonator also comprises a dielectric disc 120 having a first surface 121, a second surface 122 and a hole, wherein the second side 162 of the coaxial resonator 160 is connected or fastened to the first surface of the dielectric disc 121 wherein the coaxial resonator 160 further comprises a conductive element 150 connected to second surface 122 of the dielectric disc.

There are different types of resonators, e.g. coaxial, dielectric, crystal, ceramic, Surface Acoustic Wave (SAW) and YIG resonators. The different types of resonators may be used in different applications and/or environments. A coaxial resonator is usually implemented as high Q inductor, which when combined with a capacitor creates a resonant circuit.

The coaxial resonator 160 is illustrated in FIG. 4, in a cross-section view, having a first side 161 and a second side 162. Even though not illustrated, looking from the top, being looking from the second side 162 of the coaxial resonator 160, the coaxial resonator may in one embodiment be circular having whole at its centre. On top of the second side 162 of the coaxial resonator 160, the dielectric disc 120 is arranged in such a manner that good conductive contact is achieved between the coaxial resonator 160 and the dielectric disc 120. The dielectric disc 120 is illustrated having a first surface 121, a second surface 122 and a hole. Again, although not illustrated, looking from above the dielectric disc seen from its second surface 122 may be circular having a hole at its centre corresponding to the hole of the coaxial resonator 160. The dielectric disc may make temperature shift of frequency easier to control by choosing of proper thermal expansion coefficient of dielectric disc. By having the conductive element 150 being part of the coaxial resonator, not only is a better contact between the dielectric material and the conductive element achieved, but also, having the conductive element being relatively thin thereby somewhat flexible, the conductive element-compensates for expansion and/or shrinking of the material of e.g. the housing of the filter due to temperature changes.

FIG. 4 further illustrates the coaxial resonator 160 comprising the conductive element 150 connected to the second surface 122 of the dielectric disc. The conductive element 150 is arranged in such a manner that good conductive contact is achieved between the conductive element 150 and dielectric disc 120. In some embodiments the coaxial resonator 160 may have a first projecting element 163 that may have for example form of sharp edge or small conductive area or similar for better electric contact between coaxial resonator 160 and the housing/chassis 110/130 on the first side of coaxial resonator 161. The conductive element 150 provides good and stable conductive contact to dielectric disc and on the other side the conductive element 150 provides good conductive contact to the filter cover 140 by first contact means 141 with first fastening screw 144 when the coaxial resonator is used in filter 200. By using conductive element 150 good conductive contact to the dielectric disc 120 is separated from good conductive contact to filter cover 140. Generally, it may be difficult to obtain good conductive contact between dielectric (in particular embodiments ceramic) parts and metallic parts such as e.g. cover that usually differ significantly in temperature expansion coefficients. By using conductive element 150 good permanent contact between dielectric disc 120 and conductive element 150 may be provided. The good metallic contact between conductive element 150 and the filter cover 140 that is reversible is created by first contact means. Moreover, the conductive element 150 may be e.g. somewhat flexible to accommodate for the difference of temperature expansion coefficients of the dielectric disc 120, the conductive element 150 and filter housing 110. In some embodiments the conductive element 150 may have a second projecting element 151 that may have for example form of sharp edge or small conductive area or similar for better electric contact between conductive element 150 and the lid/cover 140 on the side of conductive element 150.

At least a part of the first surface 121 and a part of the second surface 122 may be provided with a metallic layer or may be metallised.

The metallisation or the metallic layer may enable the dielectric disc being good conductive contact with the coaxial resonator 160 and the conductive element 150. The dielectric disc 120, which may also be referred to a ceramic disc, may be partially metallised on the first and second surfaces 122 and 122 or may be completely metalized on the first and second surfaces 121 and 122. Alternatively, one surface may be partially metallised and the other may be fully metallised. In this manner, a good conductive contact between the second side 162 of the coaxial resonator 160 and the first surface 121 of the dielectric disc 120 is enabled. Likewise, a good conductive contact between the second surface 122 of the dielectric disc and the conductive element 150 is enabled.

In an example, the dielectric disc 120 is fastened to the coaxial resonator 160 by means of soldering or gluing, or a combination thereof, i.e. the first surface 121 of dielectric disc 120 is fastened to the second side 162 of coaxial resonator (160) by means of soldering and/or gluing. Likewise, the conductive element 150 is fastened to the dielectric disc 120 means of soldering or gluing, or a combination thereof, i.e. the conductive element 150 is fastened to the second surface 122 of the dielectric disc by means of soldering and/or gluing.

The soldering and/or gluing ensures good conductive contact between the dielectric disc 120 and the coaxial resonator 160 and between the dielectric disc 120 and the conductive element 150. In more detail, the first surface 121 of the dielectric disc 120 being provided with a metallic layer or being at least partially metallised, is fastened to the second side 162 of the coaxial resonator 160 by means of soldering or gluing, or a combination thereof. Likewise, the second surface 122 of the dielectric disc being provided with a metallic layer or being at least partially metallised, is fastened to the conductive element 150 by means of soldering or gluing, or a combination thereof. The fastening is conductive, whether it is soldered, glued or a combination thereof.

Figure 2:
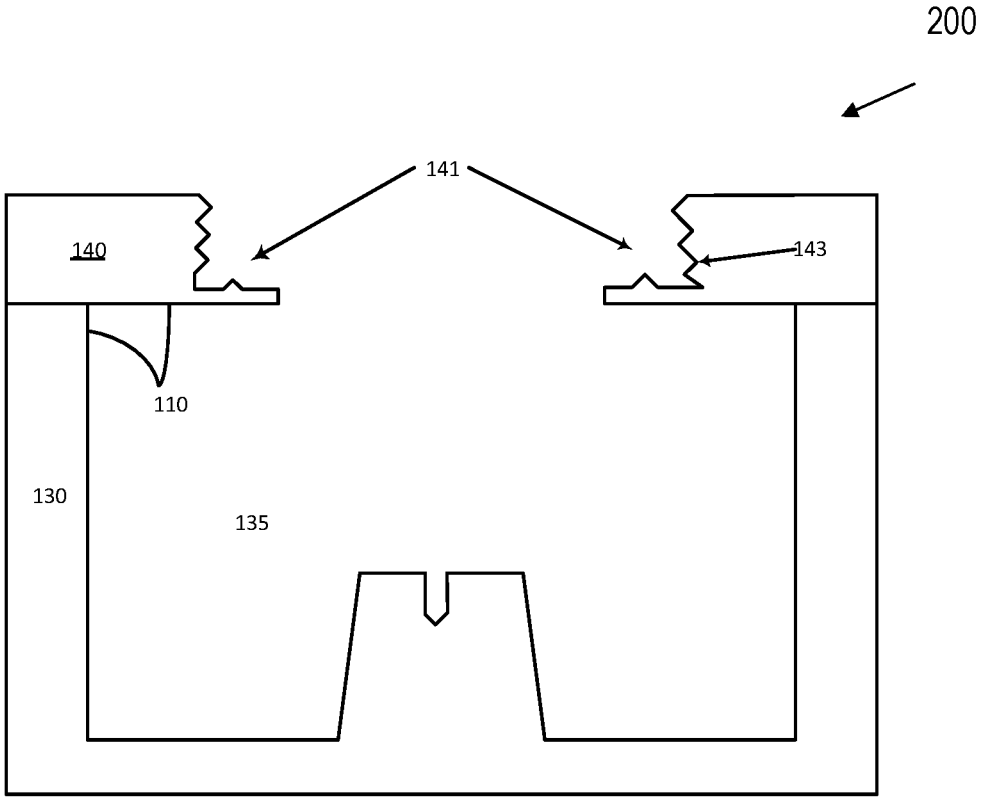
FIG. 2 is an illustration of a cross section of a filter housing 110 comprising a filter chassis 130 and filter cover 140 according to an exemplifying embodiment.

FIG. 2 is an illustration of a cross section of a filter housing 110 comprising a filter chassis 130 and filter cover 140, which may also be referred to as a lid. A filter cavity 135 is comprised in the filter housing 110/filter chassis 130. The filter cover/lid 140 comprises first contact means 141. The filter housing 110 comprises the filter chassis 130 and the cover/lid 140.

Figure 5:
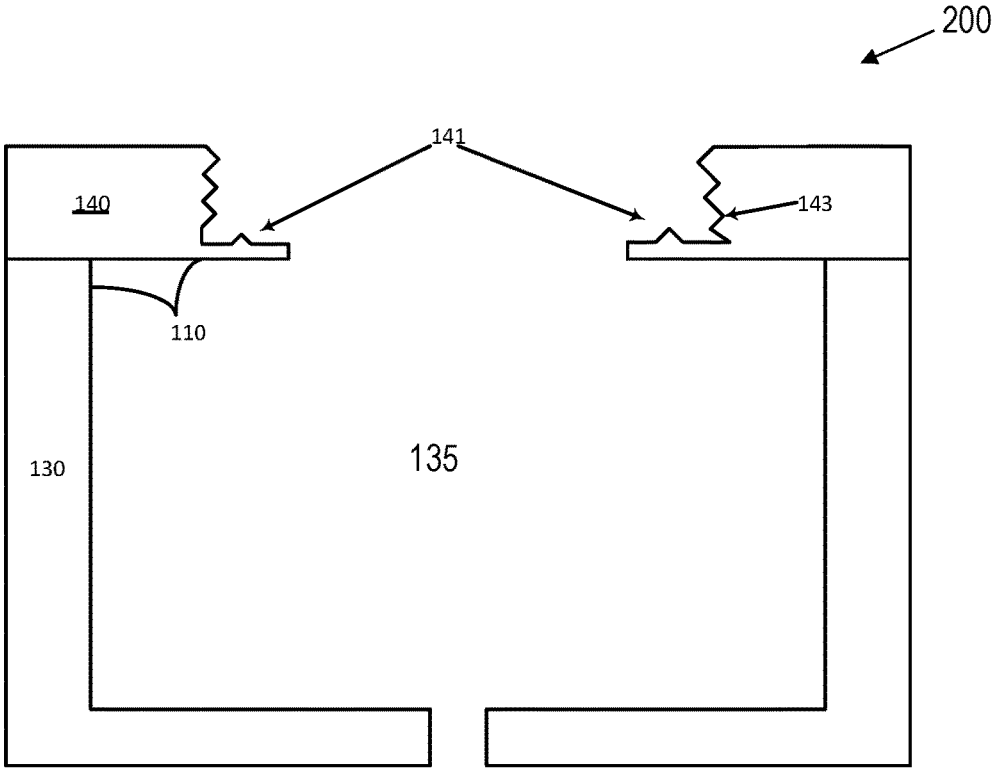
FIG. 5 is an illustration of a cross section of a filter housing 110 comprising a filter chassis 130 and filter cover 140 according to another exemplifying embodiment.

FIGS. 2 and 5 illustrate two embodiments of a filter housing 110 comprising a filter chassis 130 and filter cover 140, which in this disclosure may also be referred to as a lid 140.

Figure 3:
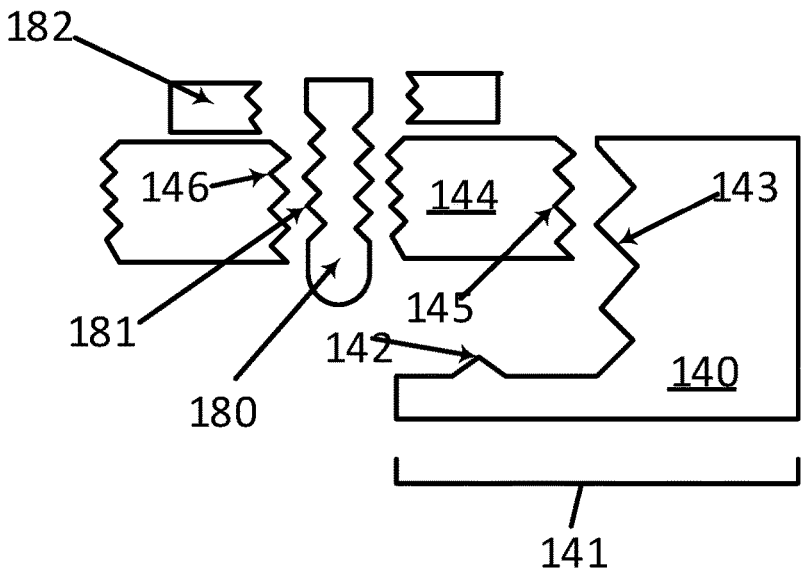
FIG. 3 is an illustration of a first fastening screw 144 that may be placed in filter cover 140 and a tuning screw 180 optionally being placed axially in the middle of first fastening screw 144.

The conductive element 150 may be adapted to be in conductive contact at the first end 141 of filter cover/lid 140 with a screw 144, also referred to herein as a first fastening screw FIG. 3 is an illustration of a first fastening screw 144 that may be placed in the filter cover 140 and a tuning screw 180 optionally being placed (or inserted) axially in the middle of first fastening screw 144. FIG. 3 also illustrates a nut 182 fastening the tuning screw 180 to first fastening screw 144. The first fastening screw 144 may be connected (or fastened or in contact with) to filter cover 140 by first contact means 141. It shall be pointed out that the tuning screw may be a self-locking screw, wherein the nut 182 is not needed. However, FIG. 3 discloses an exemplifying embodiment in which the nut 182 fastens the tuning screw 180 to the first fastening screw 144. FIG. 3 also illustrates the fastening screw 144 comprising threads 145, 146, the tuning screw 180 comprising threads 181, and also the filter cover/lid 140 comprising threads 143 in order for the respective elements to engage in one another. FIG. 3 further illustrates the filter cover/lid 140 that may comprise projecting elements 142. FIG. 4 also illustrates the coaxial resonator 160 comprising projecting elements 163 and the conductive element 150 comprising projecting elements 151. The projecting elements provides, as described above, improved conductive contact between coaxial resonator 160 and the housing/chassis 110/130 on the first side of coaxial resonator 161 and improved conductive contact between conductive element 150 and the lid/cover 140 on the side of the conductive element 150 respectively.

Consequently, the resonator 160 may further being adapted for receiving a tuning screw 180 arranged in a hole in the first fastening screw 140 and in the hole in the dielectric disc 120, and optionally also in the coaxial resonator 160.

By means of the tuning screw, the coaxial resonator may be tuned in order to tune frequency to the desired/required value.

In an embodiment, the tuning screw 180 is fastened by means of a nut 182 to the first fastening screw 144.

By means of the nut 182, the tuning screw may be held in place so that the coaxial resonator 160 does not lose its tuning due to the tuning screw moving from its position in which the coaxial resonator is tuned according to requirements.

The coaxial resonator 160 may further be adapted for being fastened to a filter chassis 130.

Since the coaxial resonator typically is to be used as a part of e.g. a filter, the coaxial resonator may be adapted for being fastened to a filter chassis 130. There are different ways of fastening the coaxial resonator 160 to the filter chassis 130 as is explained in more detail below.

The coaxial resonator may be fastened in bottom of the filter chassis 130 with a screw 170, which is also referred to as a coaxial resonator fastening screw 170. The fastening screw 170 may be integrated in the coaxial resonator 160 at the first side 161, or the fastening screw 170 may be a separate screw, wherein the coaxial resonator comprises a whole in the first side 161 through which the separate screw may be arranged to fasten the coaxial resonator 160 to the filter chassis 130.

The embodiments of the coaxial resonator may have several advantages. One possible advantage is that the embodiments may enable smaller filters at lower frequencies. The coaxial resonator may improve power handling which may be important with reduced size of filter. The quality factor may be improved. The air gap between cover lid and top surface of conventional coaxial resonator is replaced by a dielectric disc which may make temperature shift of frequency easier to control by choosing of proper thermal expansion coefficient of dielectric disc.

By having the conductive element being part of the coaxial resonator, not only is a better contact between the dielectric material and the conductive element achieved, but also, having the conductive element being relatively thin thereby somewhat flexible, the conductive element compensates for expansion and/or shrinking of the material of e.g. the housing of the filter due to temperature changes.

Further, the coaxial resonator described herein is also easily replaceable since it is fastened to the filter by being inserted into a hole of the lid or cover of the filter, the filter comprising a housing comprising a chassis and the lid/cover. The chassis may have one or more cavities and the cover/lid has one or more holes corresponding to the cavities. The coaxial resonator described herein may be inserted into the hole of the cover/lid, thereby being positioned in one of the cavities of the chassis. Once inserted into the hole, the coaxial resonator may be screwed or otherwise fastened to the bottom or the floor of the chassis and also being fastened to the cover/lid by means of being screwed in the lid/cover. In this manner, the coaxial resonator may be removed from the filter if necessary, for example if it malfunctions and needs to be replaced. A new coaxial resonator may then be inserted into the hole and fastened as described above and then optionally also tuned.

Embodiments herein also relate to a filter 200 comprising a housing 110, comprising a lid/cover 140 and a chassis 130 having one or more cavities 135 adapted for receiving a coaxial resonator 160 according to any of the embodiments described above.

The coaxial resonator may generally be used in a filter, e.g. in a base station, such as a radio base station, eNodeB, Remote Radio Head etc. The filter generally comprises a housing with cavities and a lid or cover. The coaxial resonator may be inserted into the filter, i.e. the housing, through respective holes in the lid or cover.

A filter typically comprises a housing comprising of a lid/cover and a chassis having one or more cavities adapted for receiving resonators according to prior art. The filters according to prior art generally have to be relatively large or high due to the length/height of the prior art resonators. The filter according to the solution is adapted to receive one or more coaxial resonators according to any of the embodiments described above and/or according to any of the attached claims.

The lid/cover 140 may comprise one or more holes with relation to the one or more cavities 135 to accommodate respective coaxial resonator(s).

Generally, a filter comprises a plurality of resonators or coaxial resonators. Consequently, the lid/cover 140 may comprise a plurality of holes in order to accommodate the plurality of coaxial resonators. Each coaxial resonator may be tuned to a specific frequency that is required to achieve desired filter response. All resonators may be tuned to optimal frequencies that results that the filter has required filter response.

The filter 200 may further be adapted for releasably receiving and holding respective coaxial resonator(s) 160 by inserting respective coaxial resonator(s) 160 through respective holes in the lid/cover 140 of the housing 110 and fastening respective coaxial resonator(s) 160 to the chassis 130 by means of the coaxial resonator fastening screw 170 and fastening respective coaxial resonator(s) 160 to the lid/cover 140 by means of the first fastening screw 144.

Generally, in prior art, the coaxial resonators are fixed in the lid/cover, in such a way that the replacement of a malfunctioning coaxial resonator becomes very burdensome. One solution in prior art for fixing the coaxial resonators to the lid/cover comprises pressing the resonator(s) from underneath the lid/cover. Then the lid/cover is mounted onto the chassis. Consequently, not only is there is risk of damage to the resonator(s) when being pressed with force to engage in the lid/cover, but also when replacing a malfunctioning coaxial resonator, the whole filter has to be disassembled by removing the lid/cover from the chassis and then replacing the coaxial resonator from underneath.

With embodiments of the filter and the coaxial resonator described herein, the coaxial resonator(s) is/are inserted from above, instead of underneath, into the lid/cover and then fastened by means of the first fastening screw 144. In this manner, in case a coaxial resonator malfunctions, it can easily be replaced by simply unfastening the first fastening screw 144 and the coaxial resonator fastening screw 170 and then remove the malfunctioning coaxial resonator and inserting a new one, and then fastening the new coaxial resonator by means of the first fastening screw 144 and the coaxial resonator fastening screw 170. There is no need of disassembly of the filter in order to replace a coaxial resonator.

Alternative solutions to having the conductive element form part of the coaxial resonator by means of being soldered or glued on top of the dielectric material is to have the conductive element as part of the lid or cover. However, there is a serious drawback in such a solution, since it becomes more difficult to ensure a good contact between the dielectric material and the cover. Any imperfection of the contact may result in a deterioration of resonator RF performance and the filter response may be deteriorated in such a way that the whole filter response is no longer acceptable. In one solution the additional elastic part is placed on the part of the lid that corresponds to the conductive element area. Further on, this elastic part is then pressed by a nut that is screwed into the lid. In such solution the area of lid that corresponds to the conductive element is additionally pressed by the nut other the elastic part. The elastic part is intended to compensate the length expansion due to temperature variations.

In the alternative solution, wherein the conductive element is a part of the lid/cover, replacement of a malfunctioning coaxial resonator entails removing the hole cover/lid, replacing the coaxial resonator and then fastening the cover/lid to the chassis again and then all the coaxial resonators may need to be tuned in order for the filter to work satisfactorily.

While the embodiments have been described in terms of several embodiments, it is contemplated that alternatives, modifications, permutations and equivalents thereof will become apparent upon reading of the specifications and study of the drawings. It is therefore intended that the following appended claims include such alternatives, modifications, permutations and equivalents as fall within the scope of the embodiments and defined by the pending claims.

The invention claimed is:

1. A filter structure comprising:

a coaxial resonator having a first side and a second side; and a dielectric disc having a first surface, a second surface and a hole, wherein the second side of the coaxial resonator is connected to the first surface of the dielectric disc, wherein a conductive element is connected to the second surface of the dielectric disc, wherein the conductive element is adapted to be in conductive contact at a first end of a filter cover by means of a fastening screw.

2. The filter structure according to claim 1, wherein (i) the dielectric disc is provided with a metallic layer on at least parts of the first surface or the second surface, or (ii) at least parts of the first surface or the second surface of the dielectric disc are metallized.

3. The filter structure according to claim 1, wherein the conductive element is fastened to the second surface of the dielectric disc by means of soldering or gluing.

4. The filter structure according to claim 1, wherein the first surface of the dielectric disc is fastened to the second side of the coaxial resonator by means of soldering or gluing.

5. The filter structure according to claim 1, wherein the fastening screw defines a second hole for receiving a tuning screw so that the tuning screw is positionable in the hole in the dielectric disc.

6. The filter structure according to claim 5, wherein the tuning screw is fastened by means of a nut to the fastening screw.

7. The filter structure according to claim 1, wherein the coaxial resonator is adapted for being fastened to a filter chassis.

8. The filter structure according to claim 7, wherein the coaxial resonator is adapted for being fastened to the filter chassis by means of a coaxial resonator fastening screw.

9. The filter structure according to claim 8, wherein the coaxial resonator fastening screw is integrated in the coaxial resonator at the first side, or as a separate screw, wherein the coaxial resonator comprises a second hole in the first side through which the separate screw may be arranged to fasten the coaxial resonator to the filter chassis.

10. A filter structure comprising:

a coaxial resonator having a first side and a second side; and a dielectric disc having a first surface, a second surface, and a hole, wherein the second side of the coaxial resonator is connected to the first surface of the dielectric disc, wherein a conductive element is connected to the second surface of the dielectric disc, wherein a coaxial resonator fastening screw is integrated in the coaxial resonator at the first side to fasten the coaxial resonator to a filter chassis, or as a separate screw, wherein the coaxial resonator comprises a second hole in the first side through which the separate screw may be arranged to fasten the coaxial resonator to the filter chassis.

11. The filter structure according to claim 10, wherein the conductive element is adapted to be in conductive contact at a first end of a filter cover by means of a fastening screw.

12. The filter structure according to claim 10, wherein (i) the dielectric disc is provided with a metallic layer on at least parts of the first surface or the second surface, or (ii) at least parts of the first surface or the second surface of the dielectric disc are metallized.

13. The filter structure according to claim 10, wherein the conductive element is fastened to the second surface of the dielectric disc by means of soldering or gluing, and wherein the first surface of the dielectric disc is fastened to the second side of the coaxial resonator by means of soldering or gluing.

14. A filter comprising:

a housing having a cover;

a chassis having one or more cavities adapted to receive a coaxial resonator having a first side and a second side; and a dielectric disc having a first surface, a second surface and a hole, wherein the second side of the coaxial resonator is connected to the first surface of the dielectric disc, wherein a conductive element is connected to the second surface of the dielectric disc, wherein the conductive element is adapted to be in conductive contact at a first end of the cover by means of a fastening screw.

15. The filter according to claim 14, wherein the cover comprises one or more cover holes with relation to the one or more cavities to accommodate the coaxial resonator.

16. The filter according to claim 15, further being adapted to releasably receive and hold the coaxial resonator by inserting the coaxial resonator through the one or more cover holes and fastening the coaxial resonator to the chassis by means of a coaxial resonator fastening screw.

17. The filter according to claim 14, wherein the chassis is adapted for being fastened to the coaxial resonator.

18. The filter according to claim 17, wherein the chassis is adapted for being fastened to the coaxial resonator by means of a coaxial resonator fastening screw.

19. The filter according to claim 18, wherein the coaxial resonator fastening screw is integrated in the coaxial resonator at the first side, or as a separate screw, wherein the coaxial resonator comprises a second hole in the first side through which the separate screw may be arranged to fasten the coaxial resonator to the chassis.

20. The filter structure according to claim 14, wherein the fastening screw defines a second hole for receiving a tuning screw so that the tuning screw is positionable through the second hole in the fastening screw and in the hole in the dielectric disc.

* * * * *